US007422114B2

(12) United States Patent
Guptail

(10) Patent No.: US 7,422,114 B2
(45) Date of Patent: Sep. 9, 2008

(54) VIBRATORY MATERIAL SEPARATOR HAVING AN ADJUSTABLE AIR KNIFE AND A SEPARATION TUBE

(75) Inventor: William G. Guptail, Elgin, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 545 days.

(21) Appl. No.: 11/054,574

(22) Filed: Feb. 9, 2005

(65) Prior Publication Data

US 2006/0076279 A1 Apr. 13, 2006

Related U.S. Application Data

(60) Provisional application No. 60/613,137, filed on Sep. 24, 2004.

(51) Int. Cl.
*B07C 5/00* (2006.01)

(52) U.S. Cl. ..... 209/44.2; 209/44; 209/143; 209/466; 209/467; 209/468

(58) Field of Classification Search ..... 209/44, 209/44.2, 143, 466, 467, 468, 469, 470
See application file for complete search history.

(56) References Cited

U.S. PATENT DOCUMENTS 2,026,910 A 1/1936 Olsen
2,147,822 A * 2/1939 Peale, Jr. ..... 209/467

(Continued)

FOREIGN PATENT DOCUMENTS

GB 1374204 11/1974

(Continued)

OTHER PUBLICATIONS

Examination Report from Counterpart Canadian Application (3 pages).

(Continued)

*Primary Examiner*—Patrick Mackey
*Assistant Examiner*—Terrell H Matthews
(74) *Attorney, Agent, or Firm*—Marshall, Gerstein & Borun LLP

(57) ABSTRACT

A vibratory material separating apparatus has at least two plateau conveying surfaces interrupted by a drop out opening. A composite mixture is conveyed by a vibrating action beyond the first conveying plateau and over a foraminous section in the first conveying plateau adjacent the drop out opening. Air is directed upwardly through the foraminous section to break apart the composite mixture, and an air supply formed by an air duct is also directed angularly in relationship to the plane of the first conveying plateau to further break apart the composite mixture and to propel particles of predetermined density and/or dimension to the landing area on the second conveying plateau. The air duct is adjustable between a first position and a second position to form an air stream having an adjustable and width. In another aspect, a separating tube is located between and spaced from the first and second conveying plateaus, within the drop out opening. The separating tube interacts with the air stream produced by the air duct to assist in carrying particles passing over the leading edge of the separating tube over the drop out opening and onto the landing area of the second conveying plateau.

19 Claims, 7 Drawing Sheets

U.S. PATENT DOCUMENTS

| | | | | | |
|---|---|---|---|---|---|
| 3,232,431 | A | | 2/1966 | Musschoot et al. | |
| 3,467,594 | A | | 9/1969 | Musschoot et al. | |
| 3,865,241 | A | * | 2/1975 | Crow | 209/11 |
| 4,152,255 | A | | 5/1979 | Musschoot | |
| 4,624,370 | A | * | 11/1986 | Danner et al. | 209/631 |
| 4,715,950 | A | | 12/1987 | Danner et al. | |
| 4,844,235 | A | * | 7/1989 | Sherman | 198/688.1 |
| 4,906,356 | A | | 3/1990 | Musschoot | |
| 5,108,589 | A | | 4/1992 | Sherman | |
| 5,462,172 | A | * | 10/1995 | Kumagai et al. | 209/12.1 |
| RE35,331 | E | | 9/1996 | Sherman | |
| 5,904,254 | A | * | 5/1999 | Tinsley et al. | 209/314 |
| 5,984,105 | A | | 11/1999 | Lease et al. | |
| 6,250,472 | B1 | * | 6/2001 | Grubbs et al. | 209/44.2 |
| 6,662,953 | B1 | * | 12/2003 | Rouse | 209/682 |

FOREIGN PATENT DOCUMENTS

| | | |
|---|---|---|
| WO | WO 87/06506 | 11/1987 |

OTHER PUBLICATIONS

Extended Search Report of European Patent Office, 8 pages (counterpart EPO application).

* cited by examiner

VIBRATORY MATERIAL SEPARATOR HAVING AN ADJUSTABLE AIR KNIFE AND A SEPARATION TUBE

REFERENCE TO PRIOR APPLICATION

This application claims the benefit of U.S. Provisional Application No. 60/613,137, entitled "Material Separator having an Adjustable Air Knife," filed Sep. 24, 2004, incorporated herein by reference in its entirety.

FIELD OF THE INVENTION

The present disclosure relates generally to vibratory process equipment, and more particularly to a vibrator material separator.

BACKGROUND

It is known to provide a vibratory conveying structure to separate composite mixtures including particles of different size and density. An exemplary use for such a structure is to separate accumulated materials in a wood yard. The composite mixture in this instance may include wood fiber, dirt, stones, steel, and/or other materials that commonly are found around such an operation. Other composite mixtures may include glass, plastic, paper, metal, or other materials.

A typical conveying structure may use a vibrating trough to advance the composite mixture from a supply source to a discharge area. The flow path along the trough is interrupted by a drop out opening. The composite mixture is directed from a first plateau across the drop out opening so that the trajectory of certain of the particles is intercepted by a landing surface at the discharge side of the drop out opening and beneath the elevation of the first plateau. A fixed width forced air supply is directed through the flow path and propels additional low density particles onto the landing surface or second plateau. The more dense particles fall to the bottom of the structure for accumulation in a first area while the particles on the landing surface are conveyed, typically by a vibratory force, to a second, separate area.

In some previous systems, the air supply impinging on the particles falling off of the first plateau into the drop out opening was ineffective in propelling the desired lower density particles to the landing area. For example, in some systems, the particles lodged together as clumps so that the force of the fixed width air stream was not sufficient to cause the particles to reach the landing area, though their individual weight dictated that they should follow the path of the low density material. As a result, sometimes an incomplete separation occurred. To attempt to break up the clumps, the air flow velocity was sometimes increased with a typical result that heavy unwanted particles were propelled across the drop out opening and onto the landing area.

In other systems, to attempt to break up the clumps, a foraminous fluidizing deck was provided in the conveying plateau adjacent the drop out opening for directing an air supply upward through the fluidizing deck. Air forcibly delivered through the fluidizing deck tended to aid in the initial break up of lumped particles, before the composite mixture entered the main air stream directed through the drop out opening.

However, in some instances, even the combination of a fluidizing deck and a fixed width main air stream proved ineffective in propelling the desired particles to the landing area. For example, in some instances, the composition of the particles varied depending upon initial make-up of the mixture, and/or depending upon the particular environment within which the apparatus operated. Thus, in some circumstances, the set up conditions of the fluidizing deck and the air stream were calibrated for the average composite mixture, and were sometimes not optimized for each particular mixture, resulting in incomplete separation. Consequently, a vibratory device having improved material separating capabilities is desired.

DETAILED DESCRIPTION

The examples described herein are not intended to be exhaustive or to limit the scope of the disclosure to the precise forms disclosed. Rather, the following exemplary embodiments have been chosen and described in order to best explain the principles of the disclosure and to enable others skilled in the art to follow the teachings thereof.

Figure 1:
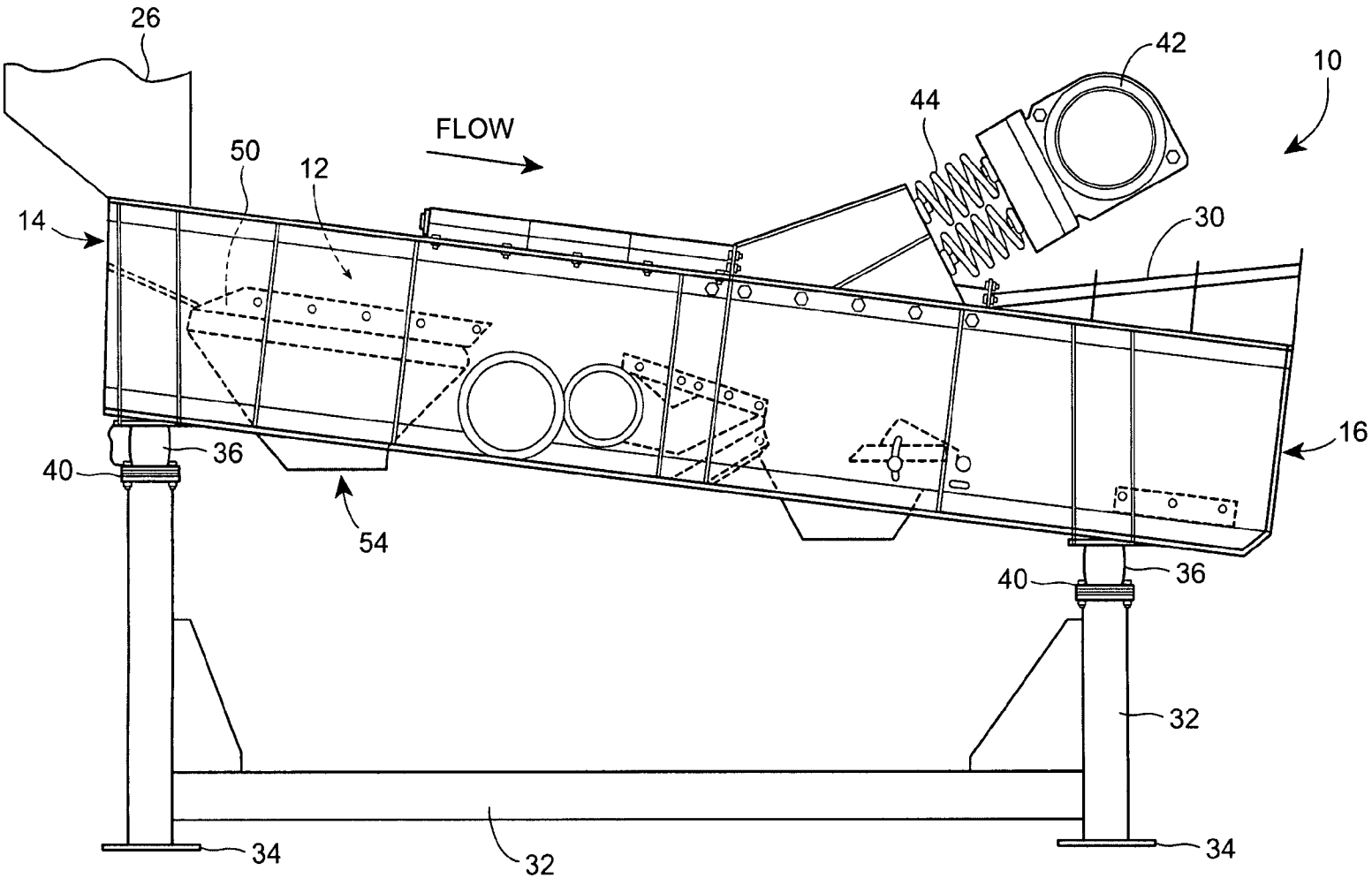
FIG. 1 is a side elevational view of a vibratory material separator having an adjustable air knife in accordance with the teachings of the present disclosure.
Figure 2:
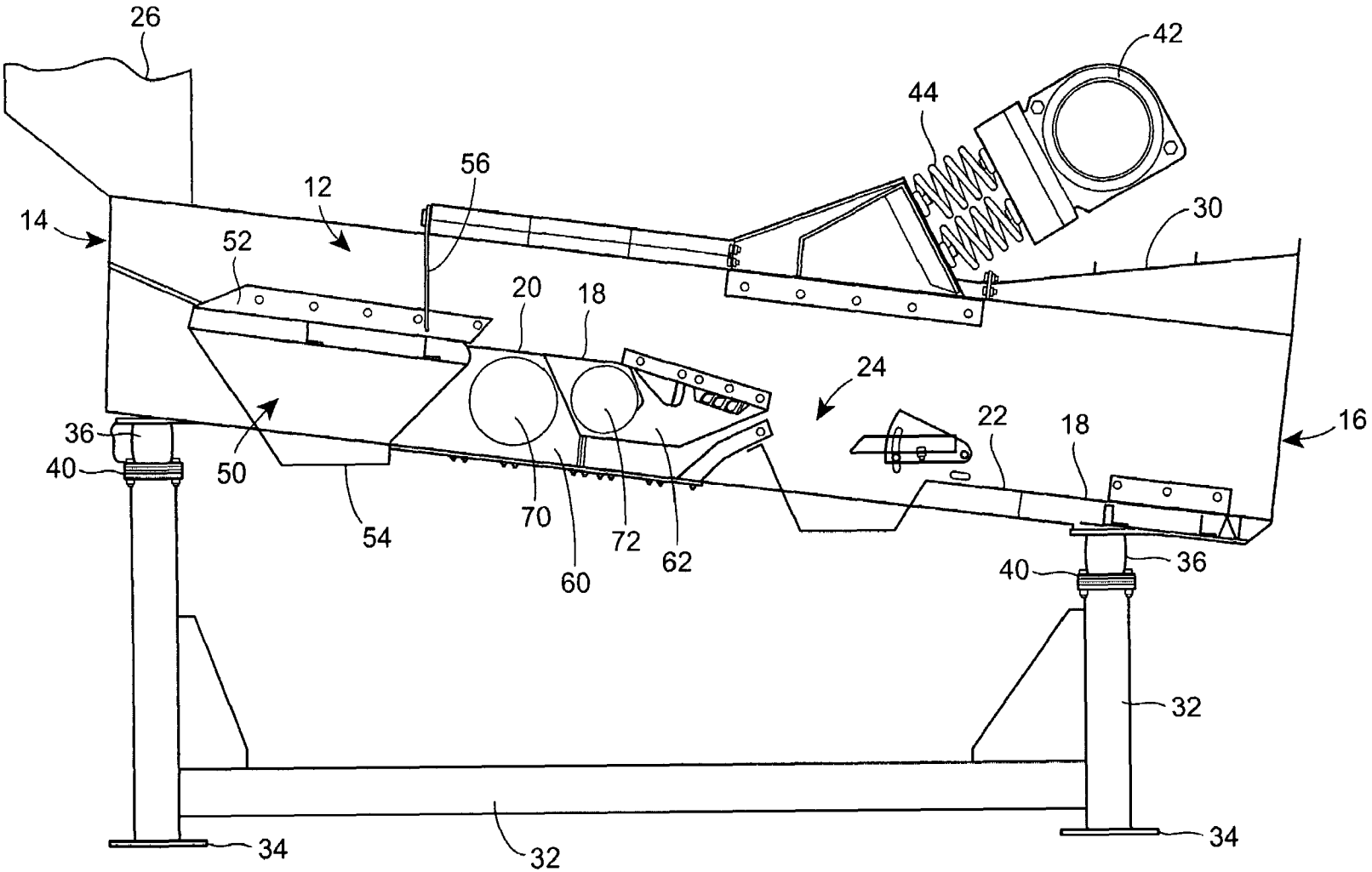
FIG. 2 is a cross sectional view of the vibratory material separator of FIG. 1.
Figure 3:
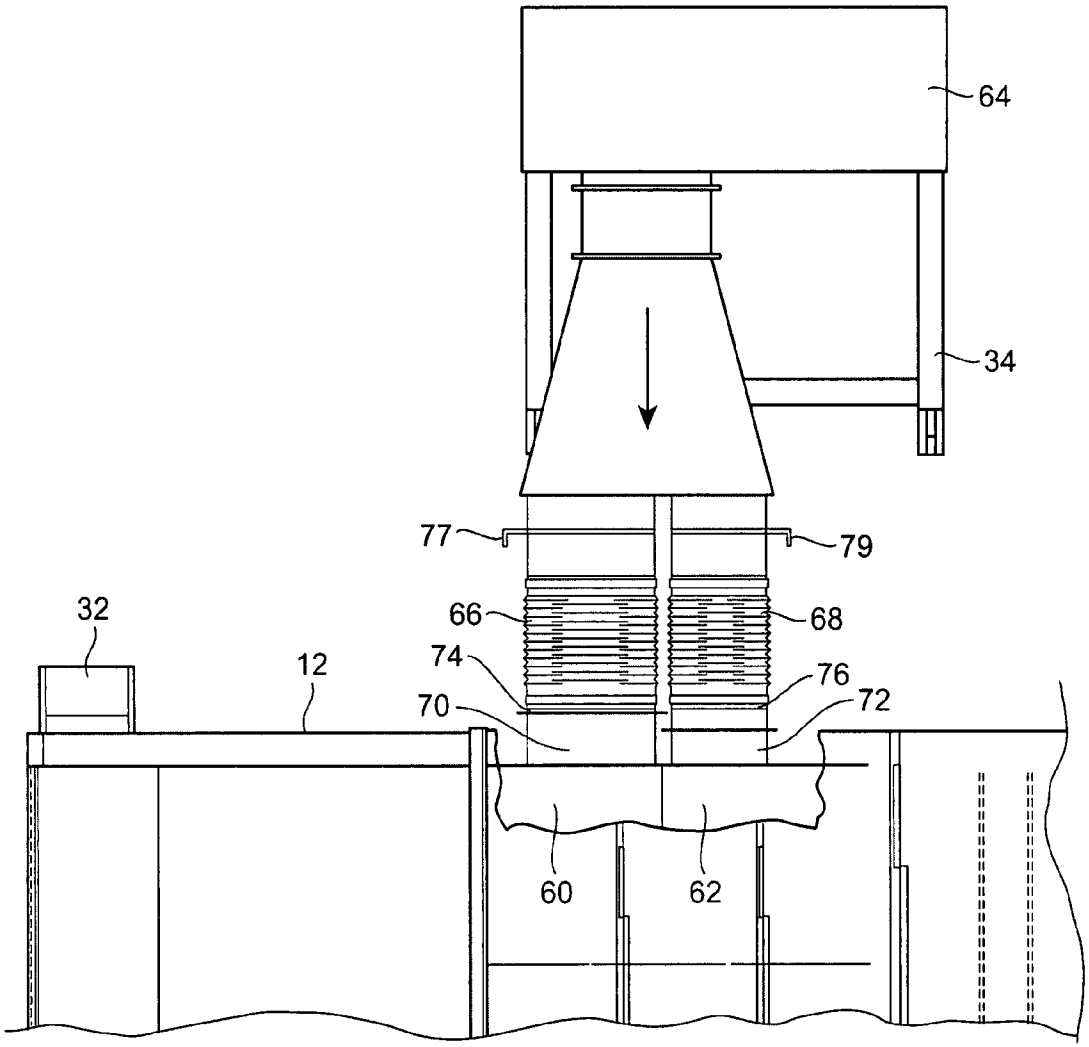
FIG. 3 is a plan view of the vibratory material separator of FIG. 1.

Referring now to FIGS. 1-3 of the drawings, a vibratory material separator 10 constructed in accordance with the teachings of the present disclosure is illustrated. The vibratory material separator 10 includes a trough 12 with an input end 14 and an open discharge end 16. The trough 12 includes a conveying surface 18 divided into two generally horizontally disposed vertically spaced plateaus including a first conveying plateau 20 and a second conveying plateau 22 between which a drop out 24 is defined. The trough 12 has a hopper 26 adjacent the input end 14 to admit a composite mixture from a supply source (not shown). A hood 30 encloses the trough 12 to confine very light particles of the composite mixture entrained in a forced air stream as described below.

The trough 12 is supported for vibratory motion relative to a base 32, bearing against a support surface 34. In this example, the trough 12 is suspended such that the trough 12 slopes generally downward from the input end 14 towards the discharge end 16 to assist in motion of the mixture as described below. Resilient isolation members 36, seated on corresponding isolation seats 40, are located between the trough 12 and base 32. The isolation members 36 may be, for example, marshmallow type isolation springs. It will be appreciated, however, that any other suitable isolation spring and/or resilient member may be used.

The separator 10 includes a vibratory actuator 42, which may be a mounted motor associated with an eccentric drive as is known. The vibratory actuator 42 may be coupled to the trough 12 through at least one link 44 such as, for instance, a spring assembly. Together, the actuator 42 and the at least one link 44 impart a controlled vibratory conveying force to the trough 12. The vibratory force moves the trough 12 in a vibratory motion that advances material on the trough 12 in a series of gentle throws and catches between the input end 14 and the discharge end 16.

An exemplary first separation stage 50 is illustrated generally in FIGS. 1-2. The first separation stage 50 includes a deck 52 coupled to the first conveying plateau 20 in a substantially co-planar configuration. The deck 52 may be, for example, a solid deck, a finger screen deck, or any other suitable deck. When utilizing a finger screen deck, "fine" particles of a predetermined size may fall through the first conveying plateau 20 for collection. For example, the deck 52 may include a plurality of apertures sized to allow particles below one-half inch in size to pass through the deck 52. To facilitate the collection of fine particles, the first separation stage 50 may additionally include a first discharge chute 54 to discharge, funnel, and collect any material which may fall through the deck 52.

Additionally, located above the first conveying plateau 20, and in this example suspended from the hood 30 above the deck 52, is a flexible flap 56. The flexible flap 56 may be constructed of any suitable material, including, for example, cloth, rubber, and/or the like. The flap 56 may assist in the confinement of particles of the composite mixture entrained in a forced air stream as described below, and may additionally aid in the prevention of any particle from traveling against the intended flow path, as will be better understood below.

As shown in FIGS. 1-3, the separator 10 further includes a pair of pressurized chambers 60, 62 supplied with air by a remote blower 64 mounted to the surface 34 separate from the trough 12. The blower 64 communicates through a pair of flexible conduits 66, 68 with the inside of each pressure chamber 60, 62 through air intakes 70, 72. The conduits 66, 68 can be readily attached and removed by use of band claps 74, 76. Additionally, the amount of air flowing into the flexible conduits may be controlled by the utilization of slide gates 77, 79. It will be appreciated that the conduits 66, 68 may be attached to the pressure chambers 60, 62 in any suitable manner, and additionally, the air flowing through the conduits 66, 68 may controlled by utilizing any suitable control means, including, for example, separate blowers, control valves, and/or similar control.

Figure 4:
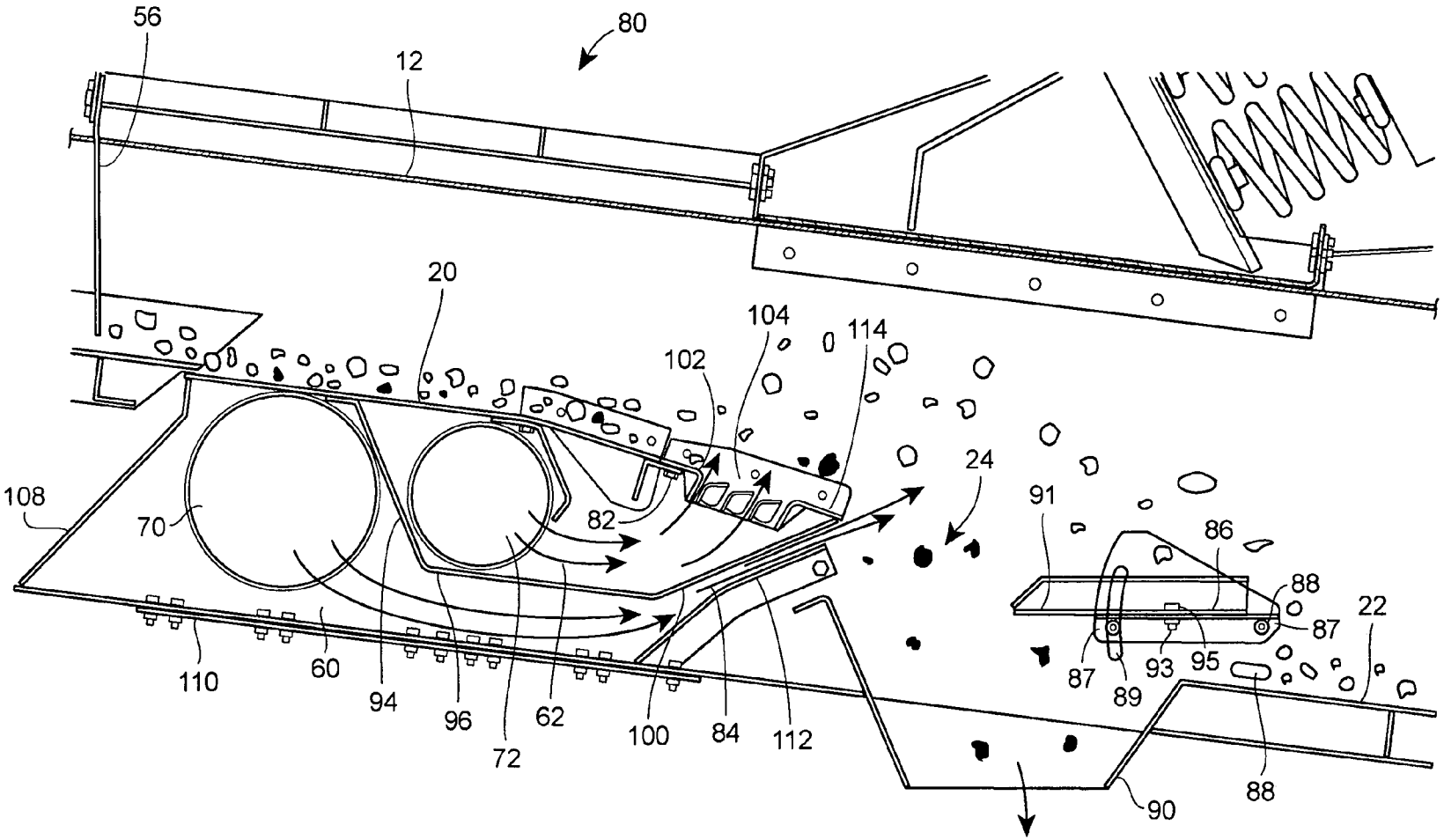
FIG. 4 is a cross sectional view of a main separation stage of the vibratory material separator of FIG. 1 and showing the adjustable air knife in a first configuration.
Figure 5:
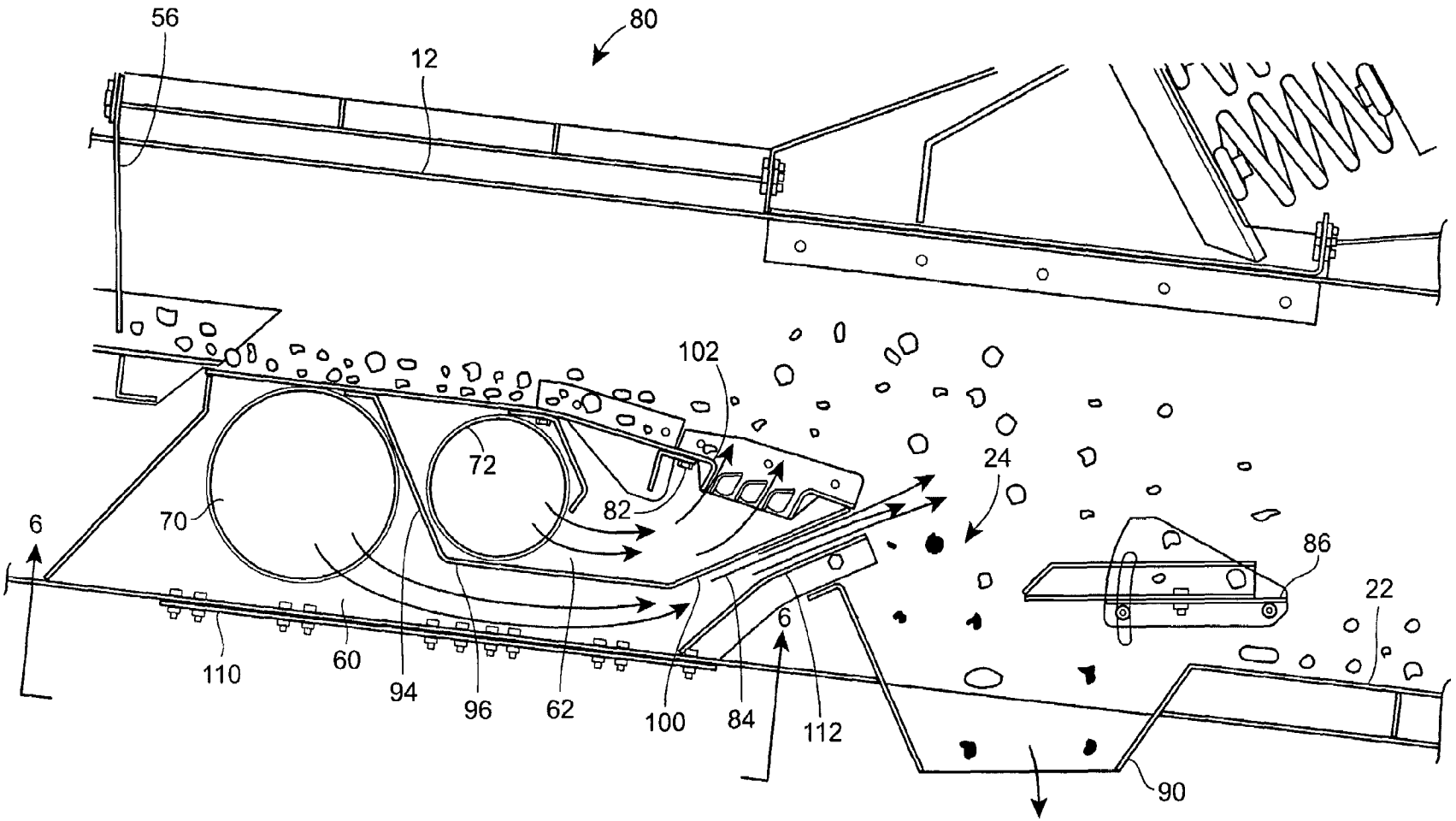
FIG. 5 is a cross sectional view of the main separation stage of the vibratory material separator of FIG. 1 and showing the adjustable air knife in a second configuration.

The separator 10 also includes a second or main separation stage 80 shown in detail in FIGS. 4-5. The second separation stage 80 generally includes the first conveying plateau 20, the pressure chambers 60, 62, an adjustable fluidizer deck 82, an adjustable air knife 84, the drop out 24, an adjustable landing plate 86, the second conveying plateau 22, and a second discharge chute 90.

In the illustrated example, the pressure chamber 62 is defined, at least in part, by the first conveying plateau 20, the fluidizer deck 82, and walls 94 and 96. As mentioned before, the pressure chamber 62 is in communication with the blower 64 through the conduit 68 secured to the air intake 72. The pressure chamber 62 also has part of its lower surface common with an air knife baffle 100 to give an upward trajectory to air flowing through the pressure chamber 62. The fluidizer deck 82 is defined as lying in a plane above the pressure chamber 62 extending between the first conveying plateau 20 and an end of the air knife baffle 100. The fluidizer deck 82 is a foraminous surface 102 having openings 104, which are, in this example, louvered openings. The openings 104 are of a size determined by the fluidizing properties of the material. For example, bark chunks typically require more fluidizing air and therefore may need larger openings 104, while saw dust typically needs less fluidizing air and therefore may need smaller openings 104. It will be appreciated that the fluidizer deck 82 may optionally be a solid surface, wherein the deck 82 effectively closes the pressure chamber 62.

The pressure chamber 60 is defined, at least in part, by the first conveying plateau 20, a wall 108 of the first discharge chute 54, a bottom wall 110, walls 94 and 96, air knife baffle 100 and an adjustable deflector plate 112. Similar to the pressure chamber 62, and as mentioned above, the pressure chamber 60 is in communication with the blower 64 through the conduit 66 secured to the air intake 70. The adjustable deflector plate 112 extends angularly upwardly from the bottom wall 110 of the trough 12 and runs generally parallel to the air knife baffle 100. Together, the baffle 100 and the adjustable deflector plate 112 form the air knife 84, which directs the air from the pressure chamber 60 upward into the drop out opening 24. The adjustable air knife 84, therefore, causes air from the pressurized chamber 60 to impinge upon particles passing over an edge 114 of the first conveying plateau 20. The action of the air upon the particles separates heavier and lighter particles.

In particular, the vibratory motion of the trough 12 causes the composite material, which is composed of materials of various densities, to move over the fluidizer deck 82 wherein the material is fluidized as it passes over the openings 104 in the foraminous surface 102. Air from the pressure chamber 62 blows up through the openings 104 to initially tumble and agitate the large bound together clumps. The fluidizing air works the various sized parts of the disintegrating clumps to form a bed of the parts of the composite material, allowing the heavier fraction to collect at the bottom or lower level of the bed. This causes some of the lighter loose particles to bob and jump above the upper level of the bed. The air from the pressure chamber 62 adds to the vibratory motion to increase the agitation and tumbling of the composite material for abrading one clump against another and at the same time the pressurized air emitting from the openings 104 in the foraminous surface will tear, shred and rip the clumped and matted mass apart prior to the main separation stage 80 of the separator 10.

Fluidizing air works the composite material bed and allows the heavier fraction to collect at the bottom or lower level of the bed. This allows the heavier particles to fall down through the adjustable air stream formed by the air knife 84, reducing lighter particles from hitting or impacting on heavies causing incomplete separation. The openings 104 in the foraminous surface 102 may be aimed in any desired direction, including for example, a generally perpendicular direction to the surface 102. The lighter loose particles that are carried forward toward the second conveying plateau 22 will be picked up by the air stream formed by the air knife 84 and propelled to the second conveying plateau 22 and/or onto the landing plate 86 where they will be conveyed and separated as any material falling thereon from the first conveying plateau 20. The particles that fall short will pass through the second discharge chute 90. Furthermore, any particles that may be blown "back" toward the inlet end 14 may be confined by the flap 56.

Figure 6:
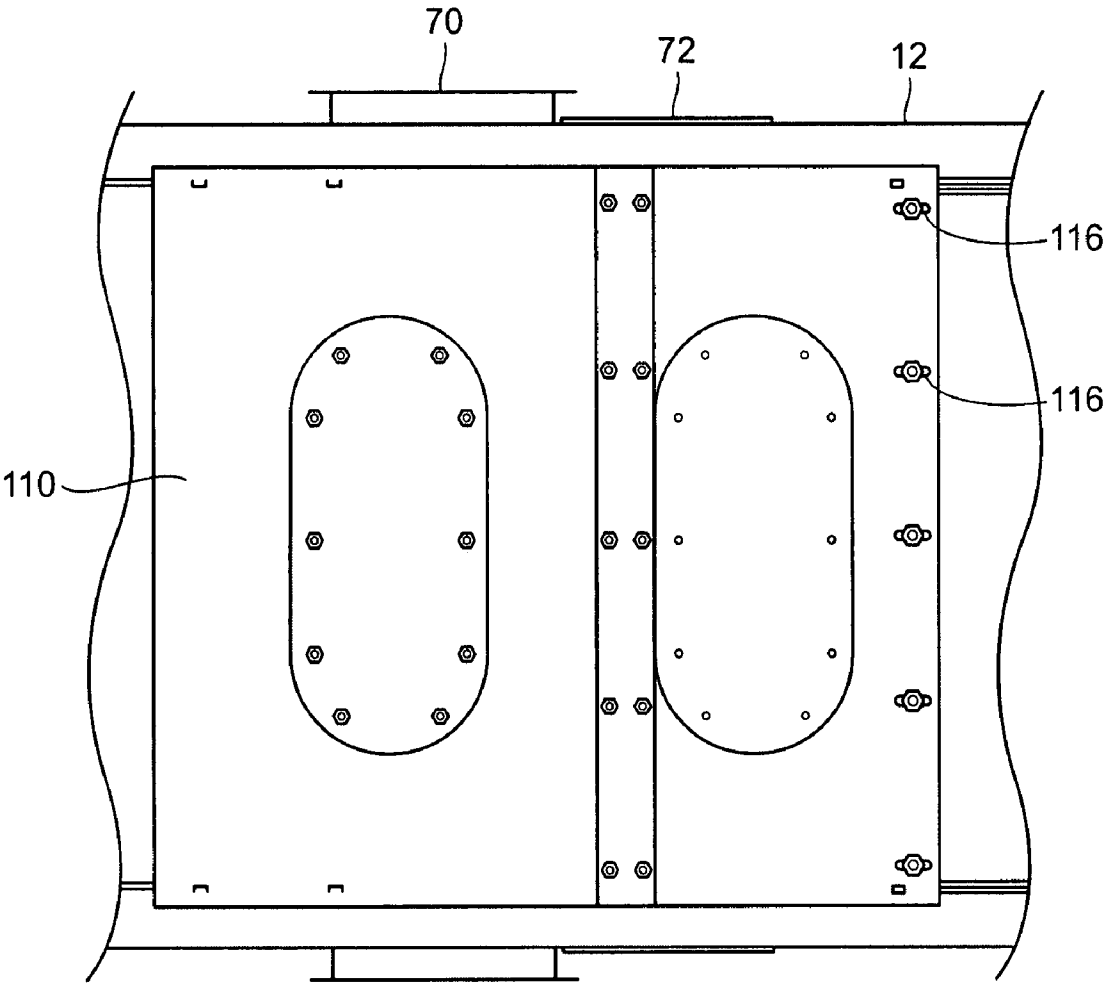
FIG. 6 is a bottom elevational view of the main separation stage of the vibratory material separator along line 6-6 of FIG. 5.

As noted above, the deflector plate 112 is adjustably mounted to the bottom wall 110 of the trough 12 and is shiftable between a first position (FIG. 4) and a second position (FIG. 5). For example, as shown in FIG. 6, the deflector plate 112 may be mounted to the bottom wall 110 of the trough 12 within at least one transverse slot 116, whereby, for purposes of adjustment, the deflector plate 112 may be shifted to alter the width of the air knife 84.

Turning to FIG. 4, the deflector plate 112 is illustrated in the first position. Specifically, the deflector plate 112 is adjusted toward the baffle 100 such that the width of the air knife 84 is narrowed. In this example, the width of the air knife 84 may be approximately one inch (1") to one and one-quarter inches (1¼"). By adjusting the deflector plate 112 towards the baffle 100, the air stream, or column of air passing between the pressurized chamber 60 and the drop out opening 24, will characteristically have a high velocity, narrow width profile. The high velocity, narrow width profile may be well suited for separating two or more commingled, relatively light objects, such as paper and glass.

Turning to FIG. 5, the deflector plate 112 is illustrated in the second position, wherein the deflector plate 112 is adjusted away from the baffle 100 such that the width of the air knife 84 is enlarged. By adjusting the deflector plate 112 away from the baffle 100, a column of air passing between the pressurized chamber 60 and the drop out opening 24 will characteristically have a lower velocity, wider width profile. The lower velocity, wider width profile may be well suited for separating other, heavier commingled objects, such as wood and rock.

While each of the first and second positions (and any number of various position therein between) is well suited to separate heavier and lighter particles as described above, each column of air formed by the two adjusted positions may be better suited for different compositions. It can be seen that by adjusting the width of the air column to suit the particular composition of the particles, higher density particles will drop through the air column and fall into the second discharge chute 90. The less dense material will be carried by the air column and will fall onto or over the landing plate 86 for collection by the second conveying plateau 22. Graduated adjustments to the deflector 112 can be made to choose a desired line of separation. By adjusting the widths of the air column, the separator 10 may be configured to separate a variety of composite mixtures within the same physical trough dimensions. In this way, a single separator 10 may service a number of different environments.

Additionally, as illustrated in FIG. 4, the landing plate 86 may be adapted to adjust the size of the drop out opening 24 and to adjust the angle of the landing surface. For example, in this embodiment, the landing plate 86 includes flanges 87 on each end of the plate. A pivot rod (not shown) passes through one of at least one opening 88 in the side walls of the trough 12 and is secured thereto by, for example, nuts threaded on threaded bolt ends. The first one of the flanges 87 has an opening through which the bolt passes to secure the end of the plate to the sidewalls trough 12. The second one of the flanges 87 is secured by nuts and bolts to the side walls of the trough 12 extending into opposed arcuate shaped slots 89. Loosening the nuts on the bolts will permit the angle of the landing plate 86 to be changed. Additionally, mounted on the plate 86 is an extension 91 which is slideably adjustable toward and away from the drop out opening 24. The slideable adjustment is effected by studs 93 on the undersurface of the extension 91 engaging through slots 95 in the extension 91, which are locked in place by a nut.

Figure 7:
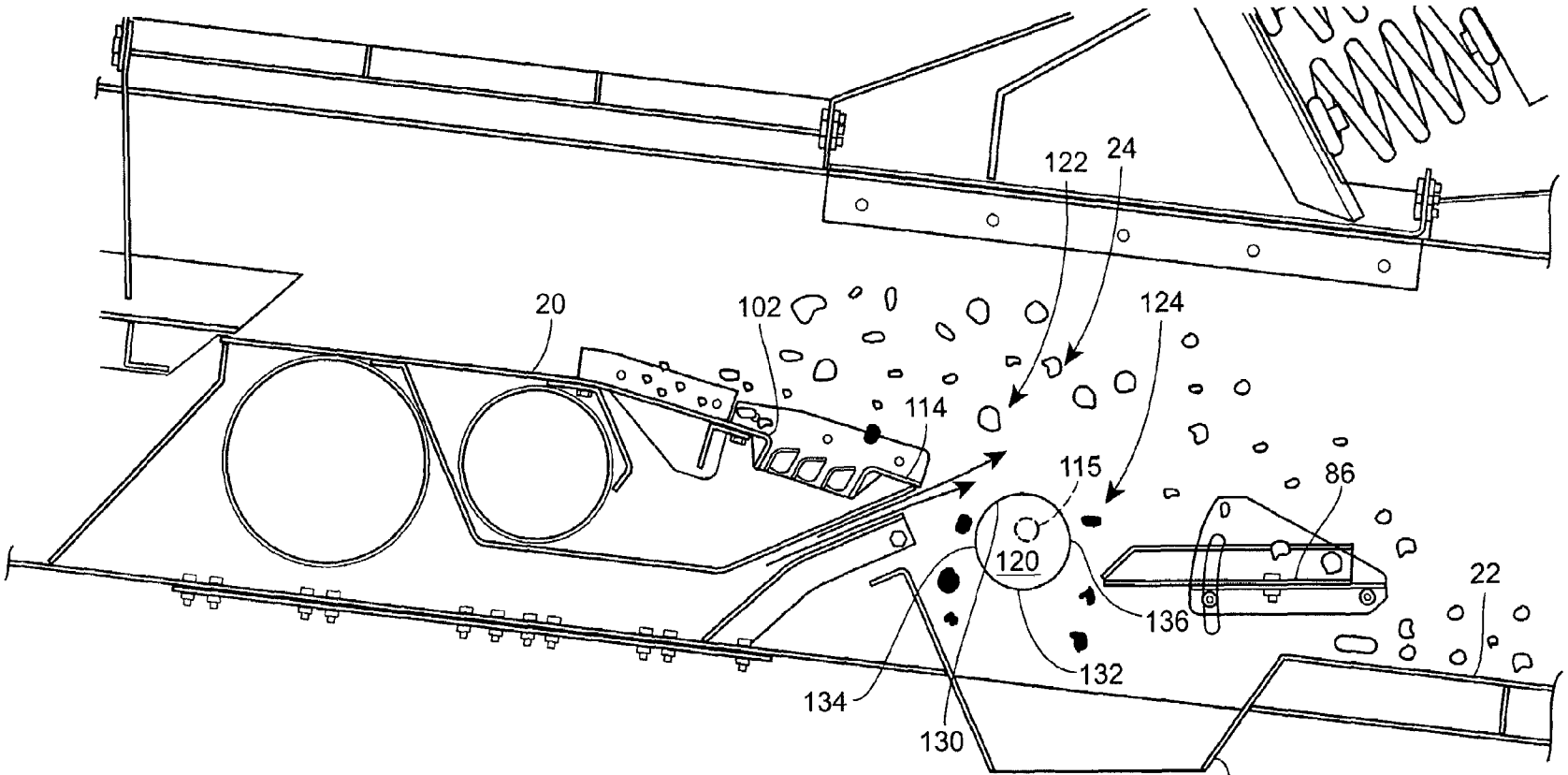
FIG. 7 is a cross sectional view of the main separation stage of the vibratory material separator similar to FIG. 4 and showing a separation tube.

The second separation stage of FIGS. 4 and 5 may have an optional separation member, such as the exemplary separation tube 120 illustrated in FIG. 7, disposed between the first conveying plateau 20 and the second conveying plateau 22 and extending substantially along the width of the trough 12. The separation tube 120 is located within the drop out opening 24 and spaced from the first conveying plateau 20 and the landing plate 86 of the second conveying plateau 22, forming a first drop out sub-opening 122 and a second drop out sub-opening 124. In the illustrated example, the separation tube 120 is positioned so as to interact with the air stream produced by the air knife 84 to produce desirable air flow characteristics. In one example, the separation tube 120 is spaced approximately 195 mm away from the edge 114 of the foraminous surface 102 and 65 mm away from the leading edge of the landing plate 86. The separation tube 120 may additionally be mounted to the trough 12 by a shaft 115 positioned eccentric with respect to a center of the tube 120. Accordingly, the position of the separation tube 120 may vary within the drop out opening 24 by rotating the tube 120 about the shaft 115. Alternatively, the separation tube 120 may be mounted on an adjustable shaft (not shown), such as a shaft mounted in a generally transverse slot, such that the position of the tube 120 may be varied. Additionally, the size and shape of the tube 120 with the drop out 24 may be chosen based on any number of desired design characteristics.

In particular, in the illustrated embodiment, the separation tube 120 is a cylindrical tube having a generally circular cross section and includes an upper surface 130, a lower surface 132, a leading edge 134 and a trailing edge 136. It will be appreciated, however, that the separation tube 120 may have any suitable shape, including, for example, semi-circular, arcuate, annular, air foil, or the like.

In operation, the separation tube 120 interacts with the air column produced by the air knife 84 to aid in the separation of the composite material. Specifically, the separation tube 120 may be placed within and/or below the air stream formed by the air knife 84 to produce an "air-foil" effect on the air stream whereby at least a portion of the air stream travels over the upper surface 130 of the separation tube 120. The "air-foil" effected air stream will thereby have a "lift and carry" effect on any material traveling within the stream. For example, as described above, the composite material will pass over the edge 110 of the first conveying plateau 20 and pass into the air stream formed by the air knife 84. Material having a relatively dense structure will pass through the air stream and fall through the first drop out sub opening 122 into the second discharge chute 90. Alternatively, some material having a relatively dense structure will strike the leading edge 134 of the separation tube 120 and will be deflected downward through the opening 122.

The remaining material will be lifted and carried by the "air-foil" effected air stream over the separation tube 120. Of the remaining material carried over the separation tube 120, some of the larger remaining particles may be heavy enough to fall out of the "air foil" affected air stream, and fall through the second drop out sub-opening 124, ultimately passing through the second discharge chute 90. The remaining lighter loose particles will continue to be propelled over the separation tube 120, over the second drop out sub-opening 124 and toward the second conveying plateau 22 and/or onto the landing plate 86, where they will be conveyed and separated as any material falling thereon from the first conveying plateau 20.

By varying the shape and position of the separation tube 120, as well as by optionally varying the width and/or velocity of the air stream, the separator 10 may be optimized for a variety of composite mixtures. Furthermore, while specific embodiments are disclosed herein, there is no intent to limit the invention to such embodiments. On the contrary, the disclosure of this application is to cover all modifications and embodiments fairly falling within the scope of the disclosure.

I claim:

1. A vibratory material separating apparatus comprising:

a conveying surface for moving a composite mixture in a conveying direction between an inlet end and a discharge end, the conveying surface having a first conveying plateau and a second conveying plateau spaced from the first conveying plateau toward the discharge end to form a drop out opening between the first and second conveying plateaus, the first conveying plateau directing the composite mixture substantially along a plane adjacent the drop out opening and having an edge at the drop out opening, the second conveying plateau having a landing area including at least a portion spaced beneath the edge of the first conveying plateau;

a vibratory actuator for vibrating the conveying surface to effect vibrating movement of the composite mixture;

a source of pressurized air including at least one pressure chamber and a blower communicating through the at least one pressure chamber; and a deflector plate for directing air from the pressurized air source through the drop out opening and angularly upward with respect to the plane of the first conveying plateau and from underneath the composite mixture moving over the first conveying plateau edge, the deflector plate having a surface with a first end and a second end spaced from a surface of the pressure chamber having a corresponding first end and a corresponding second end to define an air duct, the deflector plate translatable between a first position, wherein the deflector plate is shifted towards the first conveying plateau so that the first ends and second ends of the surface of the deflector plate and the surface of the pressure chamber have a first spacing therebetween, and a second position, wherein the deflector plate is shifted away from the first conveying plateau so that the first ends and second ends of the surface of the deflector plate and the surface of the pressure chamber have a second spacing therebetween, the second spacing being larger than the first spacing.

2. The apparatus of claim 1, further comprising:

a foraminous section in the first conveying plateau adjacent the plateau edge; and a baffle for directing air from the pressurized air source upwardly through the foraminous section to fluidize the composite material.

3. The apparatus of claim 2, wherein the foraminous section directs the air from the pressurized air source angularly with respect to the plane of the first conveying plateau.

4. The apparatus of claim 1, further comprising a flexible flap supported above the first conveying plateau and adapted to substantially prevent the movement of the composite mixture toward the inlet end.

5. The apparatus of claim 1, wherein the first conveying plateau includes a screen deck mounted to the first conveying plateau, the screen deck adapted to allow the passage of particles of a predetermined size through the screen deck, and wherein the apparatus further comprises a discharge chute disposed below the screen deck and adapted to collect the particles passing through the screen deck.

6. The apparatus of claim 1, further comprising a separating member having a curved surface mounted within the drop out opening and spaced away from and between the first conveying plateau and the second conveying plateau, the separating tube adapted to deflect at least a portion of the air from the pressurized air source over the separating member.

7. The apparatus of claim 6, wherein the separating member is adjustably mounted within the drop out opening and wherein the separation member is shiftable between a first and second position.

8. The apparatus of claim 7, wherein the separating member is adjustably mounted within the drop out opening by a shaft eccentric with respect to a center of the separation member.

9. The apparatus of claim 6, wherein the separating member has a substantially circular cross section.

10. The apparatus of claim 1, wherein the first width of the air duct is approximately one inch.

11. The apparatus of claim 1, wherein the second width of the air duct is approximately two and one-half inches.

12. A vibratory material separating apparatus comprising:

a conveying surface for moving a composite mixture in a conveying direction between an inlet end and a discharge end, the conveying surface having a first conveying plateau and a second conveying plateau spaced from the first conveying plateau toward the discharge end to form a drop out opening between the first and second conveying plateaus, the first conveying plateau directing the composite mixture substantially along a plane adjacent the drop out opening and having an edge at the drop out opening, the second conveying plateau having a landing area including at least a portion spaced beneath the edge of the first conveying plateau;

a vibratory actuator for vibrating the conveying surface to effect vibrating movement of the composite mixture;

a source of pressurized air including at least one pressure chamber and a blower communicating through the at least one pressure chamber;

a deflector plate for directing air from the pressurized air source through the drop out opening and angularly upward with respect to the plane of the first conveying plateau and from underneath the composite mixture moving over the first conveying plateau edge, the air deflected by the deflector plate causing materials of a first predetermined size and density to be propelled toward the second conveying plateau and materials other than the first predetermined size and density to fall through the drop out opening; and a separating member having a curved surface mounted within the drop out opening and spaced away from the first and second conveying plateaus, the separating member adapted to deflect at least a portion of the air from the pressurized air source over the separating member to carry the materials other than of the first predetermined size and density over the separating member, wherein materials of a second predetermined size and density fall through the drop out opening between the separating member and the second conveying plateau, and materials other than of the second predetermined size and density are propelled to the second conveying plateau, wherein the separating member comprises a tube having a substantially circular cross section.

13. The apparatus of claim 12, further comprising:

a foraminous section in the first conveying plateau adjacent the plateau edge; and a baffle for directing air from the pressurized air source upwardly through the foraminous section to fluidize the composite material.

14. The apparatus of claim 12, wherein the deflector plate cooperates with the pressure chamber to define an air duct, the deflector plate being shiftable between a first position, wherein the deflector plate is shifted towards the first conveying plateau so that the air duct has a first width, and a second position, wherein the deflector plate is shifted away from the first conveying plateau so that the air duct has a second width larger than the first width.

15. The apparatus of claim 12, wherein the first conveying plateau includes a screen deck coupled to the first conveying plateau in a substantially co-planer configuration, the screen deck adapted to allow the passage of particles of a predetermined size through the screen deck, and wherein the apparatus further comprises a discharge chute disposed below the screen deck and adapted to collect the particles passing through the screen deck.

16. The apparatus of claim 12, wherein the separating member is adjustably mounted within the drop out opening and is shiftable between a first and a second position.

17. A vibratory material separator comprising:

a conveying surface for moving a composite mixture in a conveying direction between an inlet end and a discharge end, the conveying surface having an first conveying plateau and a second conveying plateau spaced from the first conveying plateau toward the discharge end to form a drop out opening between the first and second conveying plateaus, the first conveying plateau directing the composite mixture substantially along a plane adjacent the drop out opening and having an edge at the drop out opening, the second conveying plateau having a landing area including at least a portion spaced beneath the edge of the first conveying plateau;

a vibratory actuator for vibrating the conveying surface to effect vibrating movement of the composite mixture;

a source of pressurized air including a plurality of pressure chambers and a blower communicating through the plurality of pressure chambers;

a foraminous section in the first conveying plateau adjacent the plateau edge, the foraminous section including a baffle to direct forced air from a first one of the pressure chambers upwardly through the foraminous section to fluidize and break up the composite material; and a deflector plate for directing air from a second one of the pressure chambers angularly upward with respect to the plane of the first conveying plateau to enhance breakup of the composite material and so that air from both the foraminous section and the deflector plate cooperate to cause materials of a first predetermined size and density to be propelled toward the second conveying plateau for conveyance to a first collection area, and materials other than of the first predetermined size and density to fall through the drop out opening, wherein the deflector plate having a surface with a first end and a second end spaced from a surface of the second one of the pressure chambers having a corresponding first end and a corresponding second end to define an air duct, and wherein the deflector plate is translatable between a first position, wherein the deflector plate is shifted towards the upper plateau so that the first ends and second ends of the surface of the deflector plate and the surface of the second one of pressure chambers have a first spacing therebetween, and a second position, wherein the deflector plate is shifted towards the lower plateau so that the first ends and second ends of the surface of the deflector plate and the surface of the pressure chamber have a second spacing therebetween, the second spacing being larger than the first spacing.

18. The separator of claim 17, further comprising a separating member having a curved surface mounted within the drop out opening and spaced away from and between the first conveying plateau and the second conveying plateau, the separating member adapted to deflect at least a portion of the air from the pressurized air source over the separating member to carry the materials other than of the first predetermined size and density over the separating member and wherein materials of a second predetermined size and density fall through the drop out opening between the separating member and the second conveying plateau, and materials other than of the second predetermined size and density are propelled to the second conveying plateau.

19. The separator of claim 18, wherein the separating member is adjustably mounted within the drop out opening and is shiftable between a first and a second position.

* * * * *